US006506454B2

(12) United States Patent
Ishigami et al.

(10) Patent No.: US 6,506,454 B2
(45) Date of Patent: Jan. 14, 2003

(54) PART PAINTING METHOD

(75) Inventors: Misao Ishigami, Shizuoka (JP); Takashi Yamauchi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 86 days.

(21) Appl. No.: 09/799,553

(22) Filed: Mar. 7, 2001

(65) Prior Publication Data

US 2001/0025603 A1 Oct. 4, 2001

(30) Foreign Application Priority Data

Mar. 7, 2000 (JP) ..... 2000-061576

(51) Int. Cl.[7] ..... B05D 1/02

(52) U.S. Cl. ..... 427/425; 427/164; 427/240; 427/299; 427/322; 427/421

(58) Field of Search ..... 427/425, 164, 427/240, 299, 322, 421

(56) References Cited

U.S. PATENT DOCUMENTS 6,059,434 A 5/2000 Murakoshi et al. ..... 362/510

*Primary Examiner*—Bernard Pianalto
(74) *Attorney, Agent, or Firm*—Sughrue Mion, PLLC

(57) ABSTRACT

A part painting method and apparatus in which dust, paint residue, and dripping excess paint are prevented from falling on a surface to be painted. A lens, as an example of a part to be painted, is covered with a mask body with a surface to be painted of the lens exposed through the mask body. The lens is positioned and fixed on the rear side of the mask body. The front side of the mask body, which functions as a masking surface with respect to spray paint from the paint gun, is arranged slanted downward with respect to vertical such that painting is performed with the mask body slanted at a predetermined angle so that excess paint dripping from the mask body does not drip onto the lens.

6 Claims, 3 Drawing Sheets

PART PAINTING METHOD

BACKGROUND OF THE INVENTION

The present invention relates to a part painting apparatus for applying a painting treatment to a part (generally a plastic molded component) of a device such as a lamp fixture for a vehicle, including a lens, lamp body, or decorative frame, as well as desired portions of other parts. More particularly, the invention relates to a part painting method and painting apparatus using a paint gun.

As shown in FIG. 6, in a known method and apparatus for applying an antifogging paint to the inside of a lens, which is a synthetic resin molded component, the lens 1 is mounted on a jig 2. A paint mask composed of a parent mask 3*a* and child mask 3*b* is placed on top of the lens 1 such that only the surface to be painted 1*a* of the lens is exposed. Painting is conducted with a paint gun 5 from above the surface to be painted 1*a* of the lens.

With the aforementioned conventional method and apparatus, however, because the surface to be painted 1*a* is facing upward, it is easy for dust in the air and paint residue that peels and falls from the paint gun to adhere to the surface 1*a*.

In addition, paint adhered to the child mask 3*b* from the spray paint may build up thickly, as denoted at reference numeral 7, at the inner peripheral edge of the mask 3 (child mask 3*b*) which defines the surface to be painted 1*a,* and excess paint, as denoted by reference numeral 8, may drip down on the surface to be painted 1*a,* or paint residue that has peeled off of the child mask 3*b* may drop off, creating a surface that is not proper for painting.

In order to prevent damage by drops of excess paint and paint residue, it is preferable to change the mask 3 (child mask 3*b*) often so that paint does not build up thickly at the inner peripheral edge of the mask 3 (child mask 3*b*). It is also necessary to clean the mask after it has been removed from service. Such actions are quite bothersome in practice.

Further, a jig 2 is necessary to support the lens 1, which makes the structure of the apparatus more complicated.

SUMMARY OF THE INVENTION

In view of the problems with the aforementioned conventional method and apparatus, an object of the present invention is to provide a part painting method and apparatus in which the foregoing problems, such as dust accumulation, dropping of paint residue and dripping of excess paint, have been eliminated by applying spray paint to a surface to be painted which is slanted downward with respect to vertical.

To achieve the foregoing objects, a part painting method according the invention includes the steps of covering a portion of a part with a mask body and painting a surface of the part that is exposed through the mask body with a paint gun in such a manner that the part is positioned and fixed on the rear side of the mask body of which the front side, which functions as a mask with respect to the spray paint from the paint gun, is arranged slanted downward with respect vertical. Painting is performed with the mask body slanted at a predetermined angle so that excess paint that may drip from the mask body will not drip onto the part. Even if excess paint drips from the mask body, it will not drip onto the part to be painted.

The part painting apparatus is provided with fixing means for positioning and fixing the part. The mask body is slanted at a predetermined angle with the front side thereof, which functions as a mask with respect to the spray paint from the paint gun, slanted downward so that excess paint adhered to the mask body will not drip onto the part. Also, the mask body functions as a jig for supporting the part to be painted.

A part painting apparatus according to the invention may be constructed such that a paint drip guide for leading excess paint that may drip from the mask body to a predetermined position that does not interfere with spray painting is formed on the mask body, extending along the side opposite the surface to be painted of the part.

Even if excess paint that drips from the mask body does not drip onto the part to be painted, if it drips between the paint gun and the surface to be painted it may adhere to the surface to be painted due to the pressure of the spray painting. Otherwise, if excess paint drips directly onto the paint gun, the paint gun may become fouled such that proper spray is inhibited. Therefore, a paint drip guide is extended to a predetermined position so that excess paint does not drip between the paint gun and the surface to be painted or directly onto the paint gun.

Further, the mask body may be provided with a slant adjusting means for adjusting the slant angle with respect to vertical. Using a slant adjusting means, a configuration may be obtained whereby excess paint that drips from the mask body does not drip onto the part or the paint nozzle due to appropriate adjustment of the slant of the mask body with respect to vertical.

A plurality of mask bodies may be provided on a turntable corresponding to a first position where an operator attaches/detaches a part, and a second position where a paint gun performs spray painting. In addition, each of the mask bodies may be rotatably mounted with respect to the turntable. The rear surfaces of the mask bodies in the first and second positions face the outside of the turntable.

When the turntable is rotated, one of the mask bodies on the turntable is placed in a first position where the operator attaches/detaches a part, and the other mask body then in a second position where the paint gun performs spray painting. In the first position, a part which has been painted is removed from the mask body and a new part is attached to the mask body. During this time, the paint gun spray paints the surface to be painted of the part in the second position.

The mask body may be formed in a frame shape in which the inside is open and the surface to be painted of the part is exposed facing downward inside the frame. In this case, the frame (mask body) surrounding the surface to be painted inhibits the spray paint from leaking outside the mask body.

The part to be painted may be a lens which is a part of a lamp fixture for vehicular use. In this case, if dripping paint were to adhere to the lens, drops of paint could be seen through the lens, detracting from the appearance of the lens, or adhered drops of paint could alter the light distribution pattern of the lamp. Because, according to the invention, drops of paint do not adhere to the lens, these types of problems do not occur.

DESCRIPTION OF THE PREFERRED EMBODIMENTS

Figure 1:
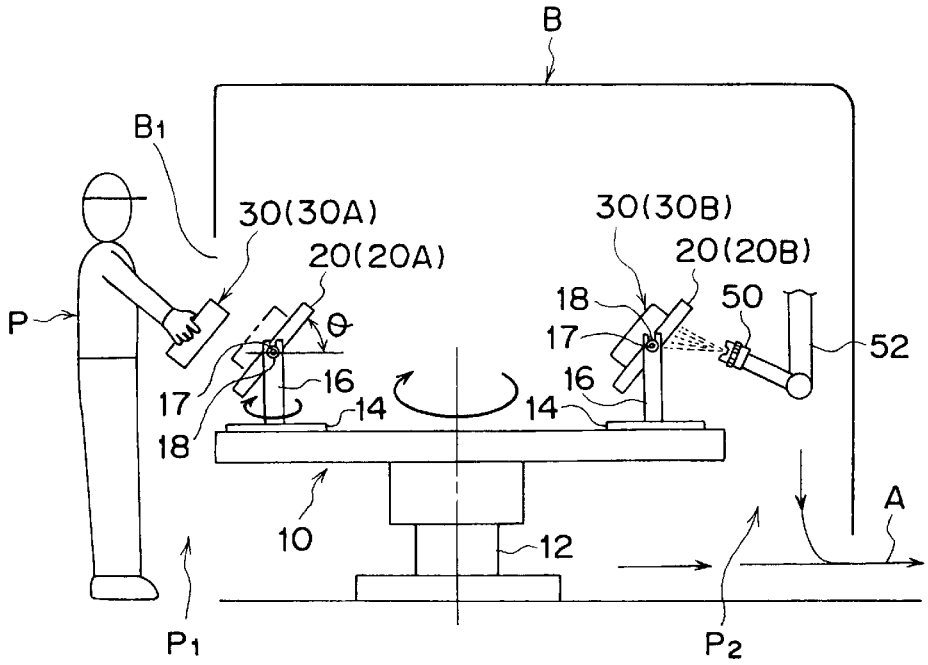
FIG. 1 is a side view showing the overall construction of a lens antifogging painting apparatus constructed in accordance with a first embodiment of the present invention.
Figure 2:
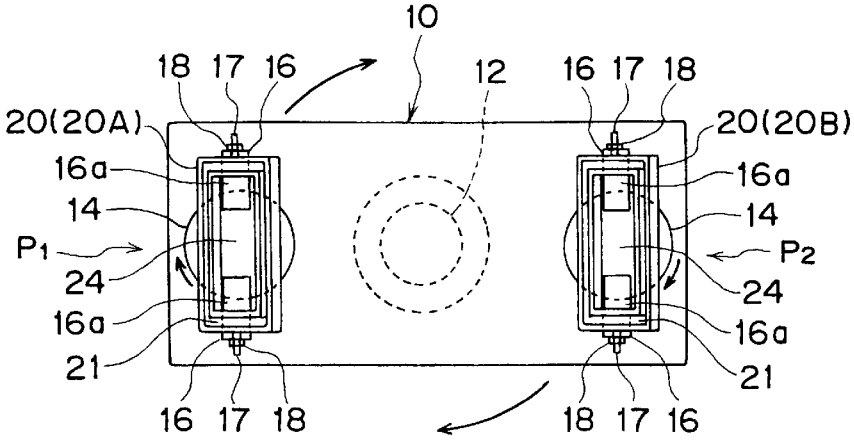
FIG. 2 is a plan view of the same apparatus.
Figure 3:
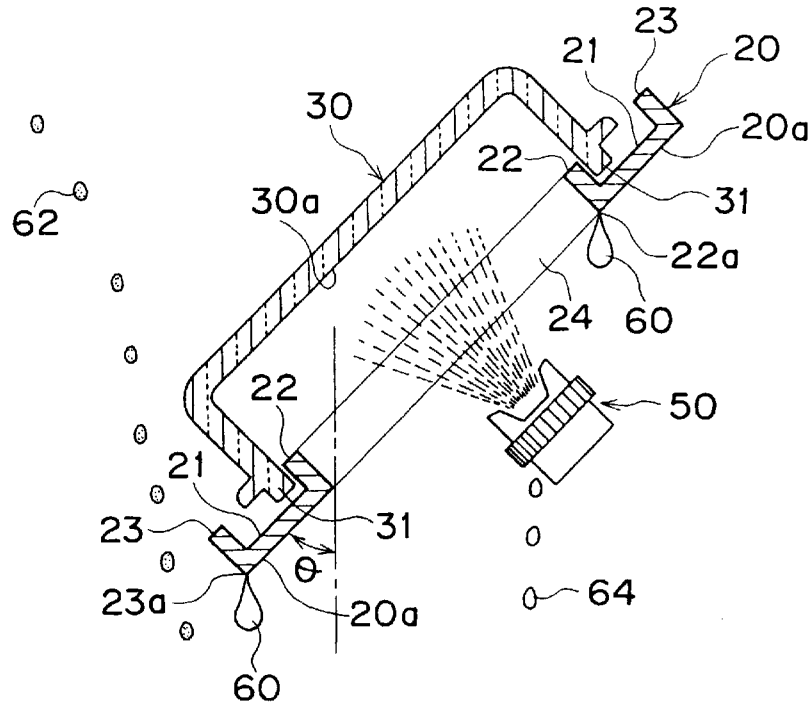
FIG. 3 is an enlarged sectional view illustrating the painting of a lens mounted on and fixed to a mask body.

FIGS. 1 through 3 show a lens antifogging painting apparatus constructed in accordance with first embodiment of the present invention. FIG. 1 is a side view showing the overall construction of the same apparatus. FIG. 2 is a plan view of the same apparatus. FIG. 3 is an enlarged sectional view showing painting being performed with a lens mounted on and fixed to a mask body.

In these figures, reference character B denotes a paint booth for applying antifogging paint to the inside of a lens 30, which is a part of a lamp fixture of a vehicle, wherein the front side where an operator P attaches/removes the lens 30 is open. Reference character $B_1$ denotes the opening.

A flat rectangular turntable 10 which rotates around a rotational axis 12 is provided in the paint booth B. Rotating tables 14 are provided near both ends on the turntable 10. A mask body 20 (20A, 20B), supported at its ends by a pair of left and right L-shaped supports 16, is integrally fixed on each of the rotating tables 14. The mask body 20A supports the lens 30A for a lamp fixture to be attached to the left side of a vehicle. The mask body 20B supports the lens 30B for a lamp fixture to be attached to the right side of a vehicle. Reference character 16a denotes a fixing portion of the support 16 and the rotating table 14.

The mask body 20 (20A, 20B), as shown enlarged in FIG. 3, which is generally flat and appears rectangular when viewed from the front, is slightly larger than the outside of the lens 30 (30A, 30B), which appears rectangular when viewed from the front and which is a part of a lamp fixture of a vehicle. In the center of the mask body 20 there is provided a hole (opening) 24 which appears rectangular when viewed from the front is slightly smaller than the outside of the lens 30.

The front side 20*a* of the mask body 20 that acts as a mask with respect to the spray paint is flat, and a vertical rib 22 that engages with the inner peripheral surface of a seal leg 31 of the lens 30 is formed on the peripheral edge of the hole 24. A vertical rib 23 is also formed on the outer peripheral edge of the mask body 20 so as to encircle the vertical rib 22, and an engaging groove 21 for engaging the seal leg 31 of the lens 30 is formed on the rear side of the mask body 20.

When the lens 30 is pushed with respect to the mask body 20 such that the seal leg 31 engages the vertical rib 22 of the engaging groove 21, the tip of the seal leg 31 abuts the bottom face of the engaging groove 21 and the lens 30 is positioned and fixed on the rear side of the mask body 20.

Also, spring loading means (not shown) such as a flat spring whose spring force acts on the seal leg 31 that engages with the vertical rib 22 is provided in a predetermined position toward the outer periphery of the outer peripheral surface of the vertical rib 22 within the engaging groove 21. The spring loading means then forces the vertical rib 22 and the seal leg 31 apart from each other such that the lens 30 is held fixed in position with respect to the mask body 20.

The mask body 20 is arranged so that the rear side on which is formed the engaging groove 21, which is the lens attaching portion, slants upward. This facilitates attachment of the lens 30 to the mask body 20 and removal of the lens 30 from the mask body 20 by the operator.

The mask body 20, as shown in FIG. 2, is supported by he tips (the upper ends) of the supports 16. The mask body 20 is fixed to the supports 16 by a bolt 17 inserted through the support 16 from the mask body 20 side and a nut 18 secured onto the tip thereof. Loosening the nut 18 enables the slant angle of the mask body 20 with respect to the support 16 to be adjusted such that the slant angle 6 of the mask body 20 with respect to vertical is able to be changed.

The upper end of the support 16 is formed in a U shape with which the bolt 17 is engageable. The mask body 20 is easily able to be attached/detached from above the support 16 by attaching/detaching the bolt 17 with respect to the U-shaped groove.

Reference numeral 50 denotes a paint gun provided in the painting position $P_2$ on the opposite side of the working position $P_1$ of the operator P so as to sandwich the turntable 10. A robot 52 controls the movement of the paint gun to a position so that it correctly faces the surface to be painted 30*a* of the lens 30 from the front side of the mask body 20. That is, the turntable 10 can be turned 180° to move the mask bodies 20 between the working position $P_1$ and the painting position $P_2$. The paint gun 50, arranged in a position separated from the turntable 10, is moved by the robot 52 from a position below the mask body 20 where it has been stopped in the painting position $P_2$, to a position correctly facing the surface to be painted 30*a* of the lens 30 and swiveled around to paint the entire surface to be painted 30*a* of the lens 30.

Also, the mask body 20 in the painting position $P_2$ on the turntable 10 is arranged slanted with respect to vertical such that the mask front side 20*a* slants downward with respect to the spray painting direction. That is, the front side of the mask body 20 in the working position $P_1$ of the operator P is slanted downward (the rear side is slanted upward), thereby facilitating attachment/detachment of the lens 30 by the operator P. Then, when the turntable 10 is rotated 180°, the rotating table 14 rotates in connection with the turntable 10 and also rotates 180°. At the painting position $P_2$ where the turntable 10 stops, the front side 20*a* of the mask body 20 not only faces the side where the paint gun 50 is installed, but is also slanted downward. As a result, the surface to be painted 30*a* of the lens 30 is covered by the paint spray of the paint gun 50 from below at an angle such that substantially no dust 62, paint residue 64 that has peeled and fallen from the paint gun 50, or paint residue that has peeled and fallen from the mask body 20 can adhere to the surface to be painted 30*a*.

Excess paint adhered to the mask body 20 from the paint spray of the paint gun 50, as denoted by reference numeral 60 in FIG. 3, drips from the lower end 22*a* (23*a*) of the vertical rib 22 (23), which is a downward facing angled portion on the mask body 20. However, because the mask body 20 is arranged slanted with respect to vertical such that the mask front side 20*a* slants downward with respect to the spray paint, there is no danger that excess paint 60 dripping from the lower end 22*a* (23*a*) of the vertical rib 22 (23) will drip onto the surface to be painted 30*a*.

A painting process using this painting apparatus now will be described.

First, the operator sets the lens 30 on the mask body 20 in the working position $P_1$. A table rotating button or lever (not shown) is operated such that the turntable 10 is rotated 180°. The rotating table 14 also begins to rotate at the same time the turntable 10 begins to rotate such that the rotating table 14 also rotates 180° when the turntable 10 rotates 180°. Accordingly, the surface to be painted of the lens 30 in the painting position $P_2$ is moved to face the paint gun 50 side, as shown in FIG. 1. The robot 52 then operates to move the paint gun 50 from below the mask body 20 to the correct position with respect to the lens surface to be painted 30*a*, whereupon the paint gun 50 paints the entire lens surface to be painted 30*a*.

When painting is completed, the paint gun 50 is moved from below the mask body 20 to a predetermined position so as not to be in the way of the rotation of the turntable 10, and the turntable 10 is rotated 180°.

The operator P in the working position $P_1$ removes the painted lens 30 from the mask body 20 and places it on a carrier conveyor (not shown) to convey it to a drying oven. A new lens 30 is again set on the mask body 20 and the turntable 10 rotated 180°. While the operator is removing the painted lens and setting a new lens on the working position $P_1$ of the turntable 10, painting by the paint gun 50 is performed on the other side (the painting position $P_2$) of the turntable 10. In this way, continuous antifogging painting of lenses 30 is performed.

In the paint booth B, an air flow such as that indicated by an arrow A, using a blower (not shown) is formed to recover and dispose of paint mist.

Figure 4:
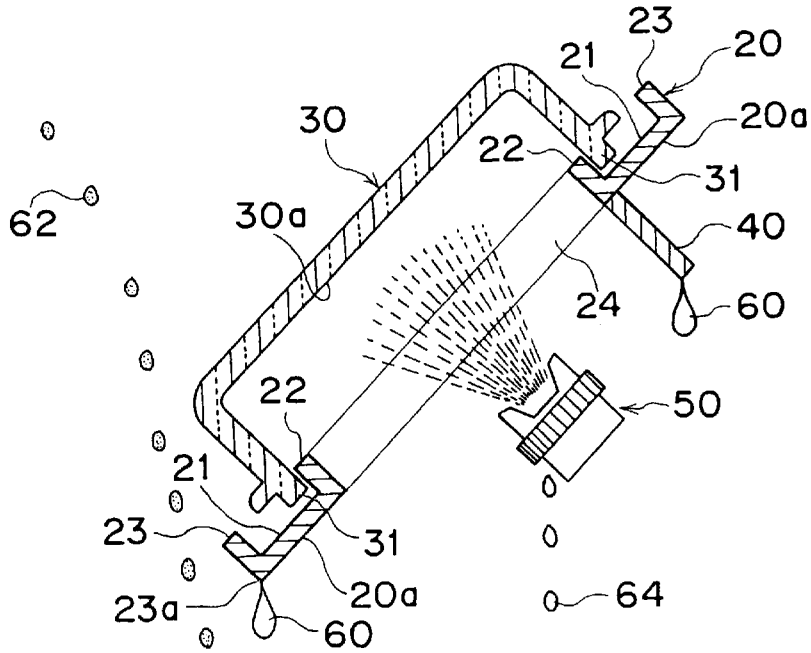
FIG. 4 is an enlarged sectional view showing painting being performed with a lens mounted on and fixed to a mask body in a lens antifogging painting apparatus of a second embodiment of the present invention.

FIG. 4, which shows a second embodiment of the invention, is an enlarged sectional view showing painting being performed with a lens mounted on and fixed to a mask body, which is an essential portion of the lens antifogging painting apparatus.

In this embodiment, an excess paint drip guide 40 is provided for leading excess paint that may drip from the lower end 22*a* of the vertical rib 22, which is an angled portion, to a position where it cannot drip onto the paint gun 50. The excess paint drip guide 40, which is of a width equivalent to the right and left lengths of the hole 24 and which extends in the opposite direction of the surface to be painted 30*a* of the lens, is provided on the inner peripheral surface of the vertical rib 22 of the mask body 20.

The excess paint drip guide 40 is formed separately from the mask body 20, but may be integrated with the mask body 20 by adhesion, welding, or some other appropriate mechanical fixing means, or may be integrated with the mask body 20 beforehand by electroforming.

Also, the length of the excess paint drip guide 40 extends is made sufficient so that any excess paint dripping from the excess paint drip guide 40 will not drip onto the paint gun 50.

Figure 5:
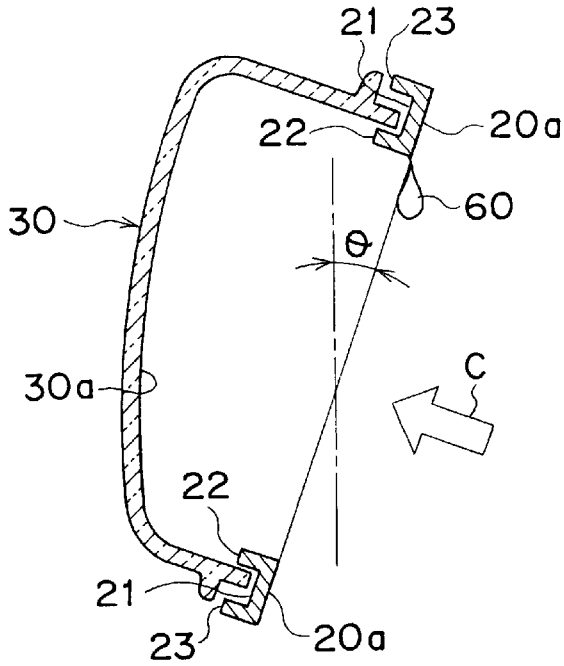
FIG. 5 is an enlarged view showing painting being performed with a lens mounted on and fixed to a mask body in a lens antifogging painting apparatus of a third embodiment of the present invention.
Figure 6:
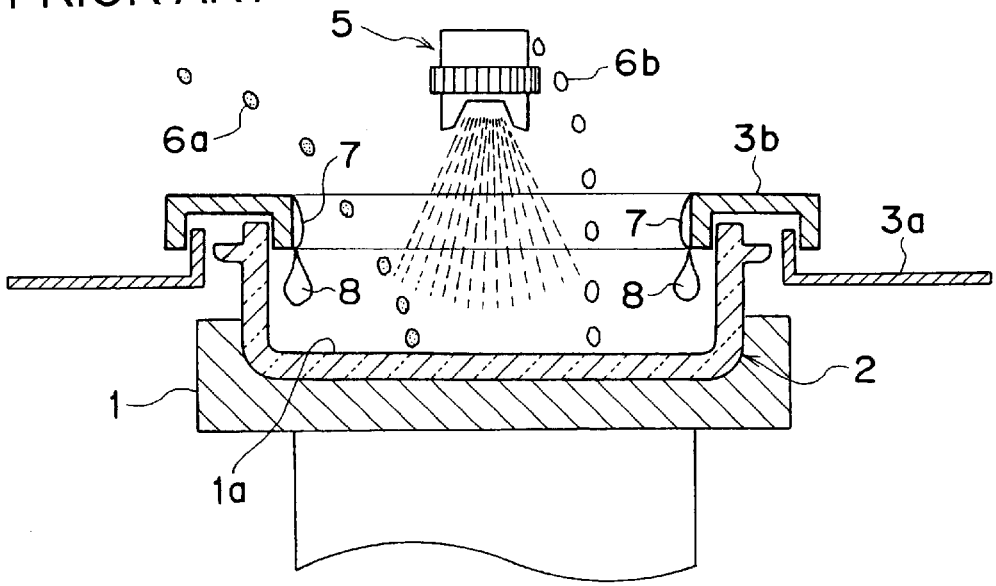
FIG. 6 PRIOR ART
FIG. 6 is a sectional view illustrating a conventional painting apparatus in a state in which a lens covered with a mask is being painted.

FIG. 5, which shows a third embodiment of the invention, is an enlarged sectional view showing painting being performed with a lens mounted on and fixed to a mask body forming an essential portion of the lens antifogging painting apparatus.

In the foregoing first and second embodiments, the mask body 20 is preferably set at a large angle (such as 45 degrees) with respect to vertical. The angle of the mask body 20 with respect to vertical in this third embodiment, however, can be any predetermined angle so long as paint dripping from the angled portion (the lower end 22*a* of the vertical rib 22) on the mask body 20, which is at a position higher than the surface to be painted 30*a* of the lens 30, does not drip onto the lens 30. Reference numeral C in FIG. 5 denotes the spray direction of the paint from the paint gun.

Because all other aspects are identical to those of the first embodiment and the same reference characters are applied, redundant descriptions thereof shall be omitted.

The aforementioned first through third embodiments relate to an example in which antifogging paint is applied to a lens 30. However, the invention is not limited to antifogging painting and can also be applied to other painting operations using a paint gun. Also, the invention can be used for painting other parts of a vehicular lamp fixture such as a reflector and lamp body.

Further, the foregoing embodiments relate to an apparatus for painting a part of a lamp fixture. However, the part to be painted is not limited to a part of a lamp fixture, and thereby it is needless to say that the apparatus of the invention can be widely applied to the painting of general parts.

As is made clear by the above description, with the part painting method according to the present invention, proper painting of a part can be performed, thus improving the yield ratio of the paint treatment because dust in the air and paint residue that has peeled off and fallen from the mask body or the paint gun does not adhere to the surface to be painted, nor does excess paint dripping from the mask body drip onto the part to be painted.

Also, because the problem of excess paint dripping from the mask body has been overcome in accordance with the teachings of the invention, the frequency of mask body replacement is reduced, and the frequency of cleaning of the mask body is also reduced.

Further, because the mask body also functions as a jig that supports the part to be painted, a separate jig for supporting the part to be painted does not need to be provided, thus simplifying the construction of the apparatus.

What is claimed is:

1. In a part painting method comprising steps of covering a portion of a part with a mask body and painting a surface to be painted of said part exposed through said mask body with a paint gun, the improvement wherein said part is positioned and fixed on a rear side of said mask body, of which a front side which functions as a mask with respect to spray paint from said paint gun is arranged slanted downward with respect to vertical, and painting is performed with said mask body slanted at a predetermined angle so that excess paint that may drip from said mask body will not drip on said part.

2. A part painting method comprising the steps of:

providing a mask body having a front surface for masking a part to be painted;

attaching a part to be painted to a rear side of said mask body;

setting an angle of said front surface at a predetermined downward angle with respect to vertical such that said excess paint that may drip from said mask body will not drip on said part; and directing a spray of paint onto said surface to be painted through said front surface of said mask at a predetermined upward angle.

3. The part painting method of claim 2, wherein said part to be painted comprises a lens for a vehicular lamp, and said step of attaching said part to be painted to said rear side of said mask body comprises engaging a seal leg of said lens with a vertical rib of said mask body.

4. A part painting method comprising the steps of:

providing a mask body having a front surface for masking a part to be painted and an excess paint drip guide;

attaching a part to be painted to a rear side of said mask body with said excess paint drip guide being above and lateral of said part;

setting an angle of said front surface at a predetermined downward angle with respect to vertical such that said excess paint that may drip from said mask body including said excess paint drip guide will not drip on said part; and directing a spray of paint onto said surface to be painted through said front surface of said mask at a predetermined upward angle.

5. A part painting method comprising the steps of:

providing a turntable having first and second rotatable tables at opposed ends of said turntable;

providing a mask body having a front surface for masking a part to be painted on each of said rotatable tables;

attaching a first part to be painted to said mask body on said first rotatable table with said front surface of said mask body to which said first part is attached being set at a predetermined downward angle with respect to vertical such that said excess paint that may drip from the mask body will not drip on said first part;

rotating said turntable to a painting gun and directing a spray of paint from said painting gun onto a surface to be painted of said first part through said front surface of said mask at a predetermined upward angle; and removing a painted part from said second rotatable table.

6. The part painting method of claim 5, wherein said mask body comprises a excess paint drip guide, said excess paint drip guide being above and lateral of said part to be painted.

* * * * *